US011517934B2

(12) United States Patent
King

(10) Patent No.: US 11,517,934 B2
(45) Date of Patent: Dec. 6, 2022

(54) SURFACE REPAIR TOOL

(71) Applicant: Ryan King, Calgary (CA)

(72) Inventor: Ryan King, Calgary (CA)

( * ) Notice: Subject to any disclaimer, the term of this patent is extended or adjusted under 35 U.S.C. 154(b) by 970 days.

(21) Appl. No.: 16/271,932

(22) Filed: Feb. 11, 2019

(65) Prior Publication Data

US 2020/0256067 A1 Aug. 13, 2020

(51) Int. Cl.

| | |
|---|---|
| ***B05C 17/005*** | (2006.01) |
| ***E04F 21/02*** | (2006.01) |
| ***E04F 21/165*** | (2006.01) |
| ***B24B 7/18*** | (2006.01) |
| ***B05C 17/10*** | (2006.01) |

(52) U.S. Cl.

CPC .... *B05C 17/0052* (2013.01); *B05C 17/00506* (2013.01); *B05C 17/00516* (2013.01); *B05C 17/00583* (2013.01); *B05C 17/10* (2013.01); *B24B 7/182* (2013.01); *E04F 21/026* (2013.01); *E04F 21/1652* (2013.01); *B05C 17/00586* (2013.01)

(58) Field of Classification Search

CPC ..... B05C 17/00583; B05C 17/00506; B05C 17/00516; B05C 17/10; B05C 17/0052; A46B 11/0037; B44D 3/16; B44D 3/162; B44D 3/164; B44D 3/06; B44D 3/10; B44D 3/105

See application file for complete search history.

(56) References Cited

U.S. PATENT DOCUMENTS

| | | | | |
|---|---|---|---|---|
| 708,709 | A | 9/1902 | Henneberry et al. | |
| 2,197,579 | A | 4/1940 | Hooper | |
| 2,489,940 | A | 11/1949 | Trotta | |
| 2,848,141 | A | 8/1958 | Intagliata | |
| 3,248,754 | A * | 5/1966 | De Mario | E04F 21/32 222/105 |
| 4,399,170 | A * | 8/1983 | Janssen | E04F 21/00 264/129 |
| 4,991,989 | A | 2/1991 | Fitjer | |
| 5,605,259 | A | 2/1997 | Clawson et al. | |
| 6,375,377 | B1 | 4/2002 | Lowery | |
| 6,767,151 | B1 | 7/2004 | Owens | |
| 6,769,147 | B1 * | 8/2004 | Stubbs | B25F 1/04 30/169 |
| 6,968,978 | B1 | 11/2005 | Matthews | |
| D598,727 | S | 7/2009 | Carlton | |
| 9,259,757 | B1 | 2/2016 | Santarsiero | |

(Continued)

*Primary Examiner* — Patrick M. Buechner

(74) *Attorney, Agent, or Firm* — Lewellyn Law, PLLC; Stephen Lewellyn

(57) ABSTRACT

A surface repair tool for repairing defects in surfaces includes a handle with an applicator blade extending from one end of the handle and a sanding device extending from the opposite end of the handle. The handle includes a receptacle into which is removably received a container of repair compound. The applicator blade includes an application surface and a flow passage that has an inlet and an orifice formed through the application surface. Squeezing the container causes repair compound in the container to flow through the flow passage of the applicator blade and out of the orifice where it is dispensed onto the applicator surface to be spread on a surface needing repair. Once the repair compound dries, the sanding device is used to sand the repair compound to a desire finish.

12 Claims, 9 Drawing Sheets

(56) References Cited

U.S. PATENT DOCUMENTS

| | | | | |
|---|---|---|---|---|
| 9,896,242 | B2 | 2/2018 | Olson | |
| 10,413,930 | B2 * | 9/2019 | Evans | B05C 17/10 |
| 2003/0150472 | A1 * | 8/2003 | Johnson | A46B 11/0037 222/103 |
| 2005/0217034 | A1 | 10/2005 | Miller et al. | |
| 2011/0027753 | A1 * | 2/2011 | Maurat | A61C 9/0026 433/141 |
| 2016/0221174 | A1 * | 8/2016 | Raymond | E04F 21/026 |
| 2017/0021379 | A1 | 1/2017 | Evans | |

* cited by examiner

SURFACE REPAIR TOOL

FIELD OF THE INVENTION

The present invention relates generally to repairing surfaces, and more particularly, relating to a surface repair tool for applying a repair compound and sanding the repair compound.

BACKGROUND OF THE INVENTION

Holes, cracks, dents or other imperfections in walls, ceilings, and other surfaces are often repaired by a repair compound, such as spackle (spackling) or putty. Spackling is applied to the surface of a wall to fill a hole in the wall, for example, using a putty knife. In practice, the putty knife is dipped into a container of spackling to coat the knife and then the spackling is spread across the surface. After the spackling dries and hardens, it is sanded smooth by sandpaper or a sanding block, for example. This process has many drawbacks, such as needing multiple tools, and it can be messy by having to dip the putty knife into the container of spackling, which often results in wasted spackling and contaminated spackling.

Recognizing these problems, several compound dispensing and applying devices have been devised to repair surfaces. While these prior devices fulfil their respective objectives and requirements, there remains a need for an improved tool for repairing surfaces with a repair compound.

SUMMARY OF THE INVENTION

In view of the foregoing described and other inherent disadvantages in known surface repair devices, embodiments of the present invention provide a new surface repair tool for applying repair compound to a surface and sanding dried repair compound.

An object of embodiments of the present invention is to provide a single tool that can be used for both applying a repair compound to a surface and sanding the repair compound after it dries.

Another object of embodiment of the present invention is to provide a surface repair tool that holds a container of repair compound that is dispensed through an applicator blade and onto an application surface of the blade for spreading onto a surface to be repaired.

Another object of embodiments of the present invention is to provide a surface repair tool prevents repair compound waste and eliminates repair compound contamination.

In general, in one aspect, a surface repair tool includes a handle having opposite first and second ends, a length extending between the first and second ends, and first and second opposite sides. The handle has an internal receptacle for removably receiving a container therein and a passage extending from an end wall of the receptacle through an end wall of the handle at the first end of the handle. A blade is attached to and extends outwardly from the first end of the handle. The blade has a blade edge, an application surface, and a flow passage terminating at an orifice formed through the application surface. A collapsible container is removably positioned in the receptacle and has an opening through which a repair compound in the container can flow. The opening of the collapsible container is fluidically connected to the flow passage of the blade. A slide captively is held, for back-and-forth movement, in a longitudinal slot formed through the first side of the handle. The slide having a thumb button located on an exterior side of the handle and a curved bow located on an interior side of the handle within the receptacle. The curved bow pressing against the collapsible container when the slide is moved in a direction toward the first end to compress the container and dispense repair compound through the orifice and onto the application surface. And a sanding pad is attached to the second end of the handle and an abrasive is located on the sanding pad.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
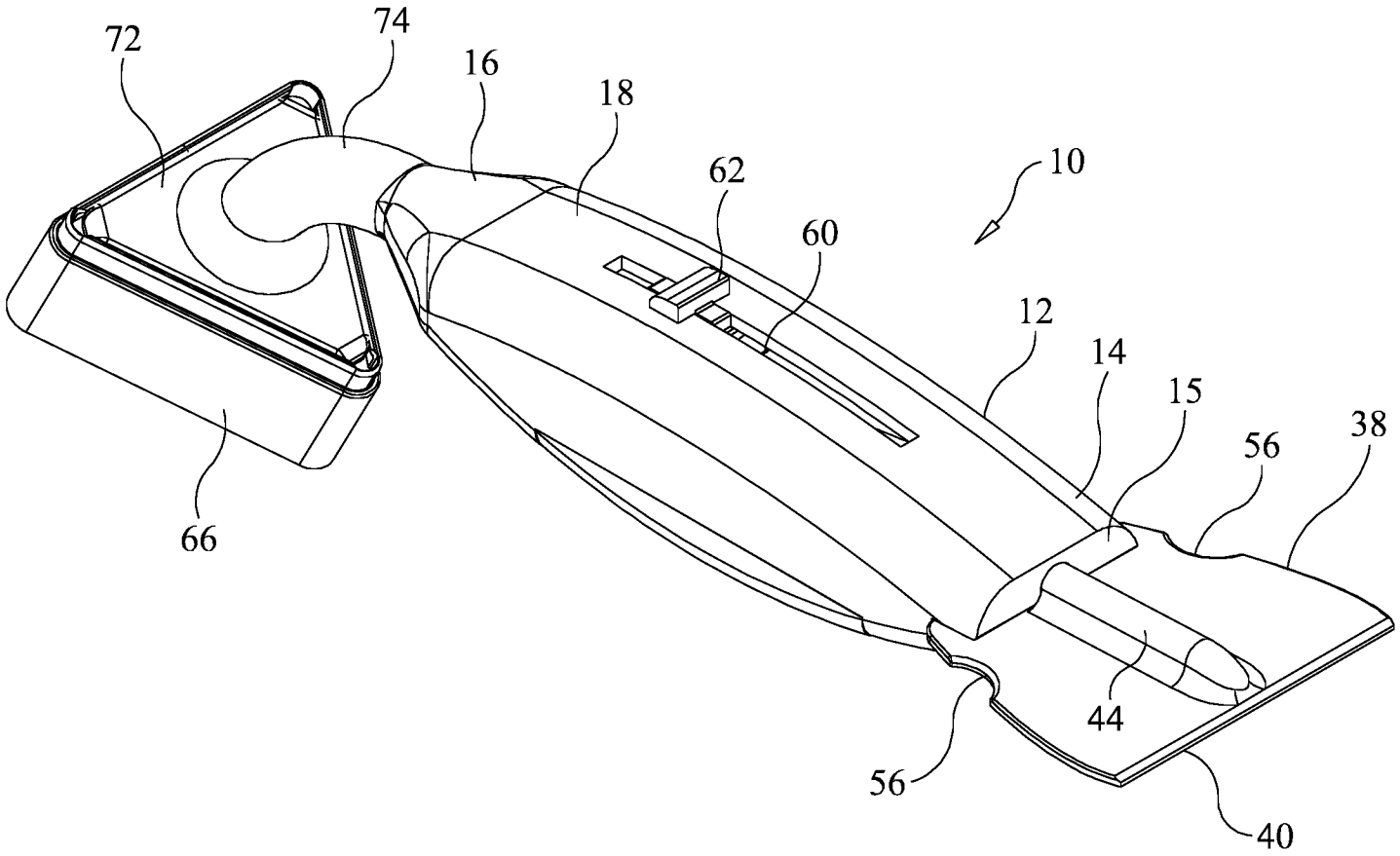
FIG. 1 is a first side perspective view of a surface repair tool according to an embodiment of the invention.
Figure 2:
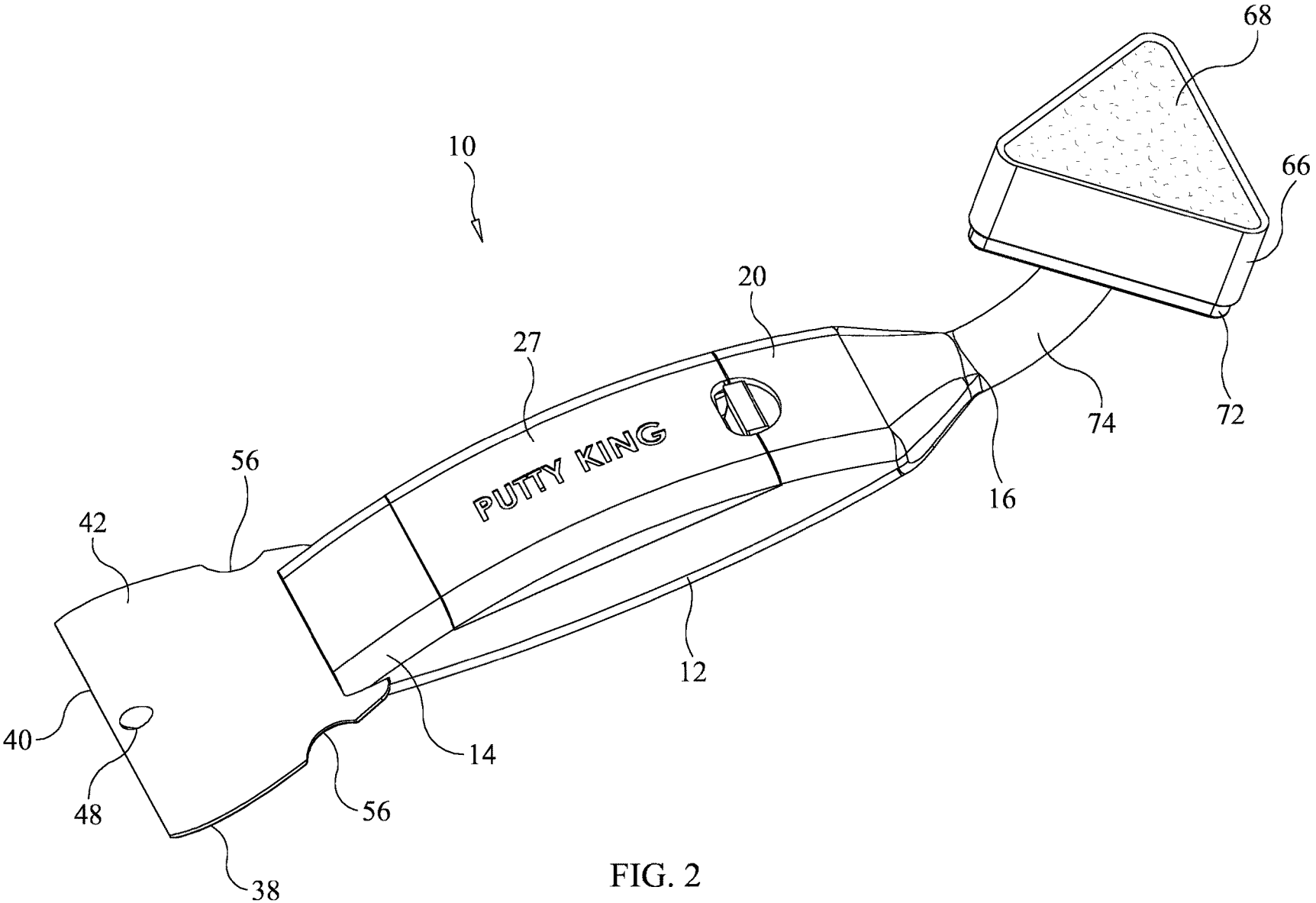
FIG. 2 is a second side perspective view of a surface repair tool according to an embodiment of invention.
Figure 3:
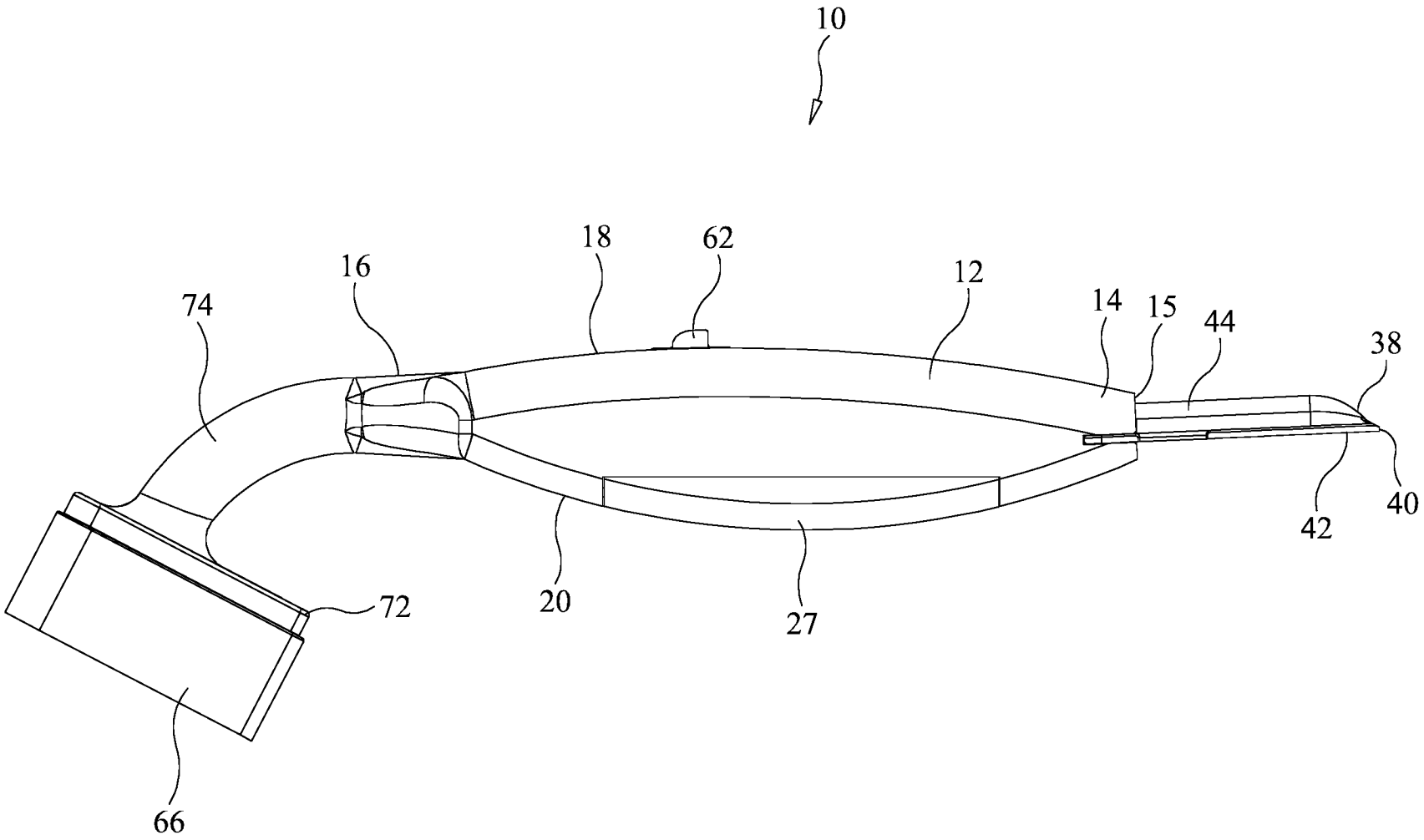
FIG. 3 is a side elevation view of a surface repair tool according to an embodiment of invention.
Figure 4:
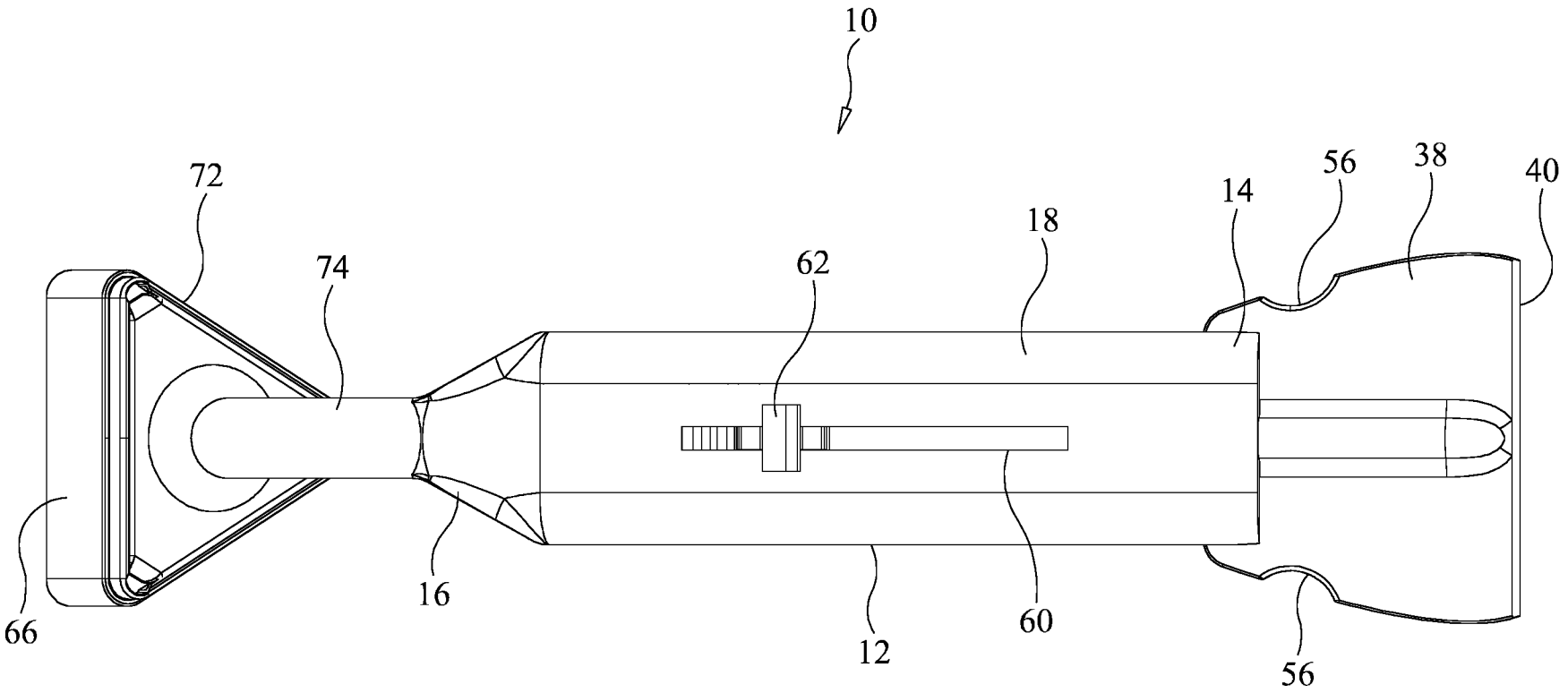
FIG. 4 is a first side plan view of a surface repair tool according to an embodiment of invention.
Figure 5:
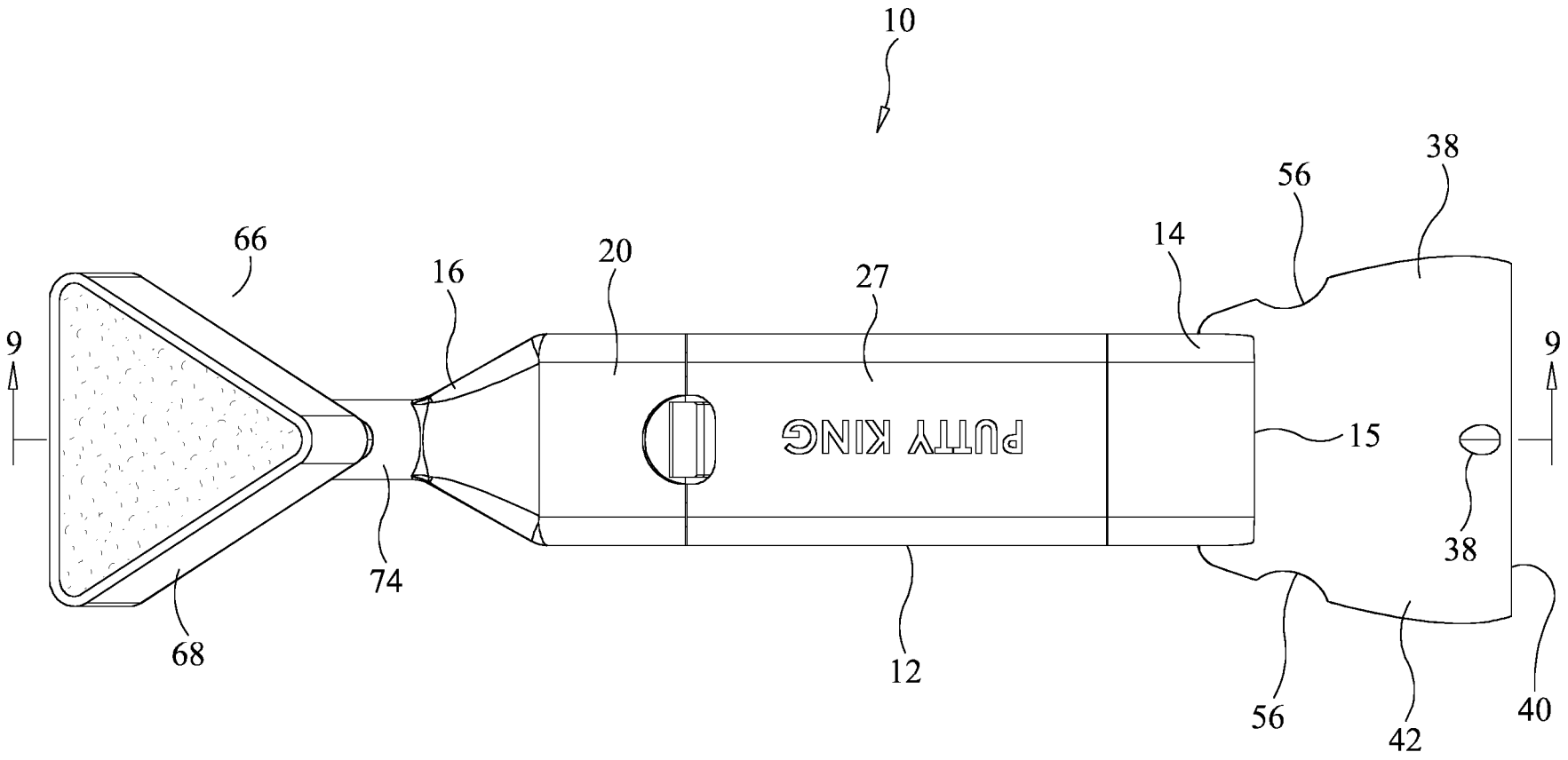
FIG. 5 is a second side plan view of a surface repair tool according to an embodiment of invention.
Figure 6:
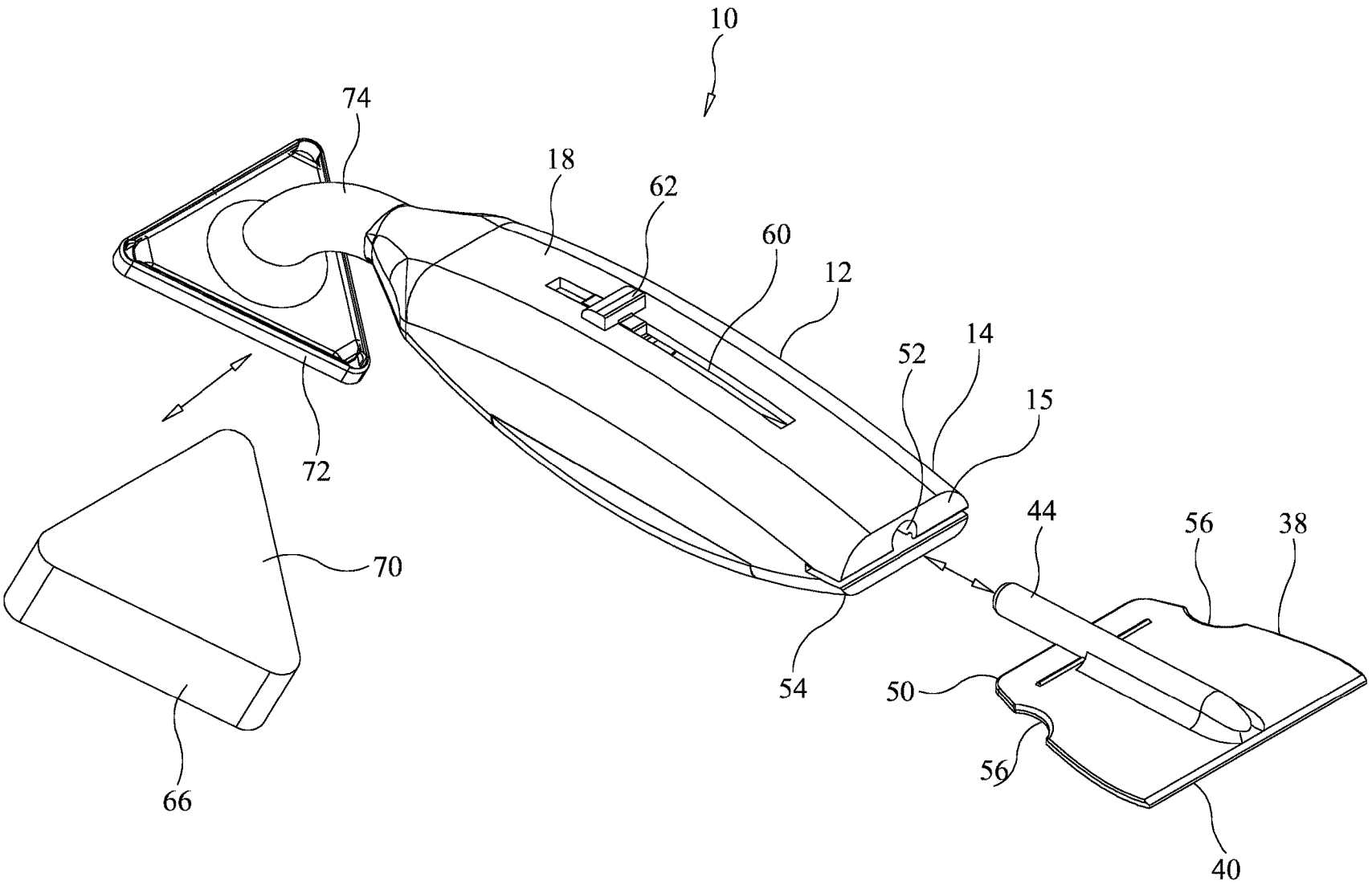
FIG. 6 is a first side, explode view of a surface repair tool according to an embodiment of invention.
Figure 7:
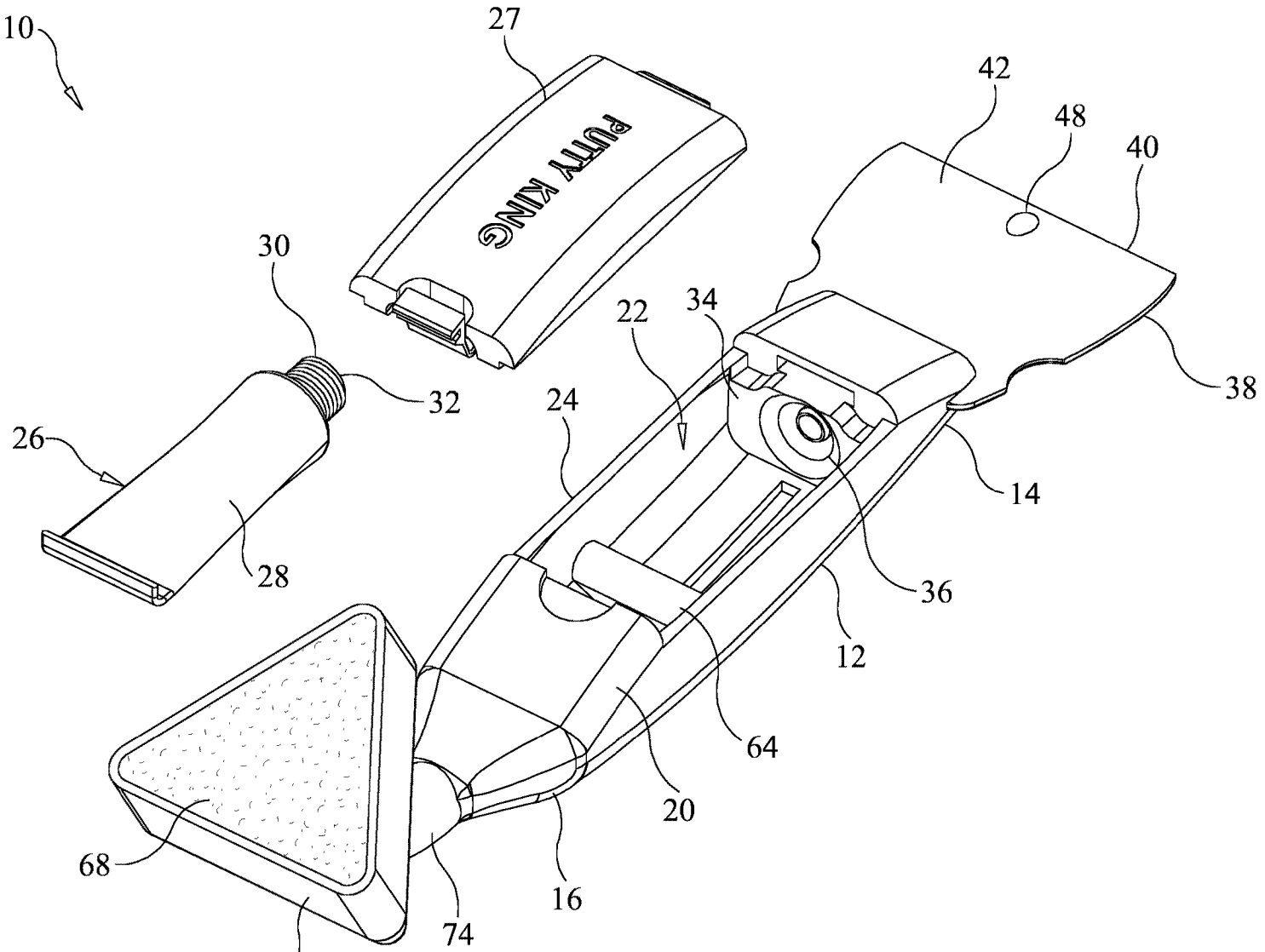
FIG. 7 is a second side, partial exploded view of a surface repair tool according to an embodiment of invention.
Figure 8:
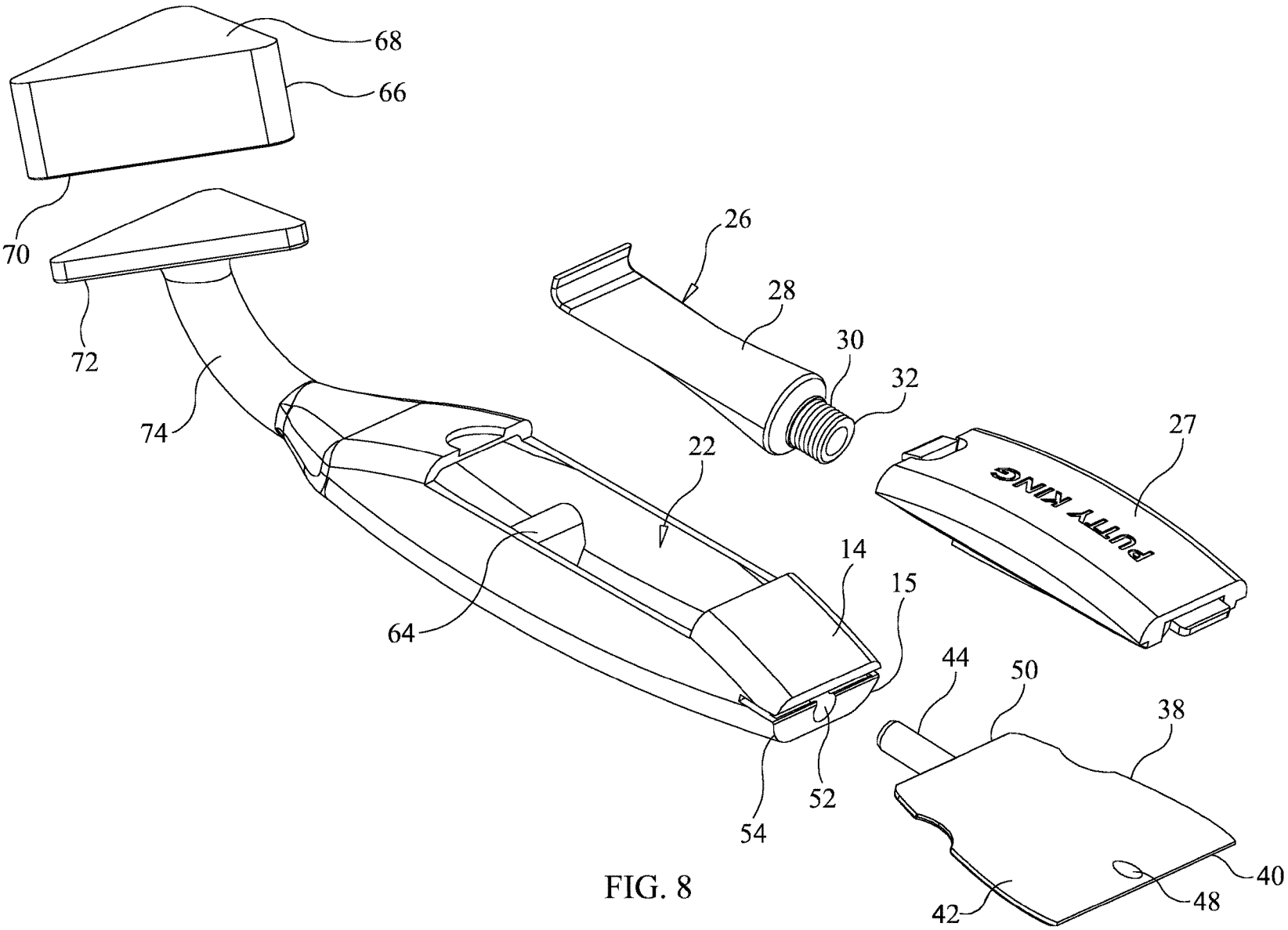
FIG. 8 is a second side, exploded view of a surface repair tool according to an embodiment of invention from a second vantage point.
Figure 9:
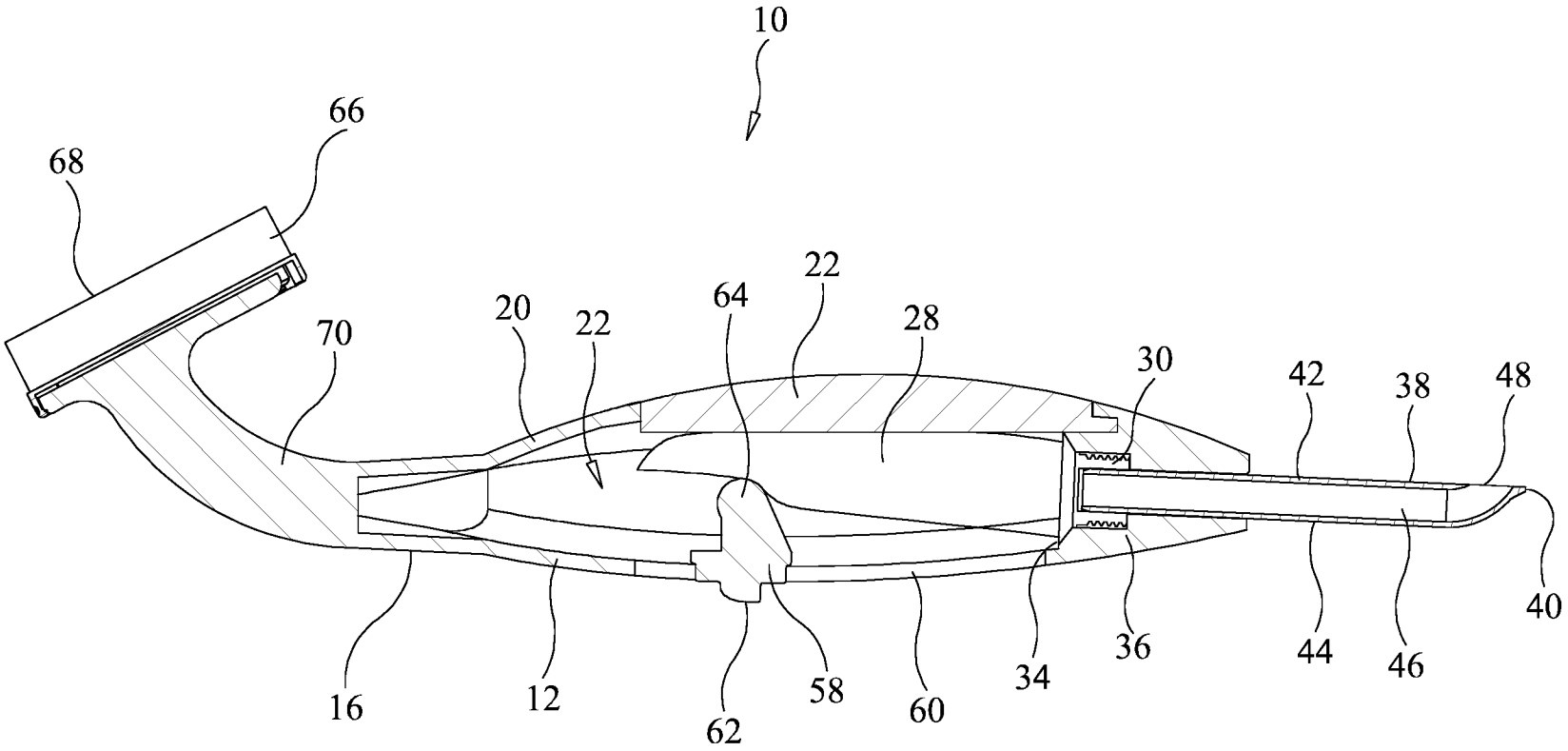
FIG. 9 is a cross-sectional view taken along line 9-9 of FIG. 5.

With reference first to FIGS. 1-9, there is representatively illustrated a surface repair tool 10 according to an embodiment of the invention. Tool 10 includes a handle 12, constructed from a suitable material, such as, for example plastic, and configured to be grasped by a user's hand when using the tool. Handle 12 has a length that extends between opposite ends 14 and 16 and has opposite sides 18 and 20.

Handle 12 defines an interior receptacle 22 that is accessible through an opening 24 that is formed through side 20 of the handle. Receptacle 22 is configured to removably receive therein a container 26 containing a repair compound. Container 26 has a container body 28 that is made of a collapsible material, such as, for example foil, and neck 30 with an opening 32 through which repair compound can flow when the container body is compressed. Opening 32 may be sealed by a puncturable membrane. End wall 34 of the receptacle 22 defines an aperture 36 that is configured to removably receive neck 30 of the container 26 when the container is disposed within the receptacle. A cover 27 is removably attachable to handle 12 to close the opening 24 and hold the container 26 in the receptacle.

Tool 10 further includes an applicator blade 38 for applying and spreading repair compound on a surface. In the illustrated embodiment, blade 38 is removably attached to the handle 12 at end 14 and is configured to be fluidically connected to container 26 for dispensing and applying repair compound from the container onto a surface.

More particularly, blade 38 has a blade edge 40, an application surface 42, a neck 44, a flow passage 46 extending through the neck and terminating at an orifice 48 formed through the application surface, and a back edge 50 that is opposite of the blade edge. The neck 44 of the blade extends outwardly beyond the back edge 50 and terminates at a free end with an opening into the flow passage. Blade 38 is removably attached to handle 12 by inserting the neck 44 into passage 52, which is formed through end wall 15 of the handle and connects with aperture 36. As the blade is inserted into passage 52, the back edge 50 engages with a slot 54 formed across end wall 15 of the handle. When the back edge 50 of the blade 38 is fully seated in slot 54, a friction lock prevents the blade from being disconnected from the handle 12. The blade 38 can be disconnected from the handle by pulling on the blade with enough force to overcome the locking force. Side edges of the blade may have finger recesses 56 that allow one to grip the blade and pull it free of the handle.

With the blade 38 fully attached to the handle 12 the free end of the neck 44 extends through opening 32 of container 26, thereby fluidically connecting the container with the flow passage 46. In this manner, repair compound can flow from the container 26, through the flow passage 46, and then dispensed through orifice 48 onto the application surface 42 of the blade to be spread on a surface needing repair. If opening 32 of container 26 is sealed by a pierceable membrane, the free end of neck 44 may be configured to pierce such a membrane when inserted through the opening.

As discussed above, container body 28 is made of a collapsible material, such as foil, so the repair compound can be squeezed from container 26. To this end, tool 10 includes an ejector mechanism for compressing or squeezing the container body 28 to dispense the repair compound from the container. In the illustrated embodiment, the ejector mechanism includes a slide 58 that is slidably engaged with the handle 12 to be moved longitudinally back-and-forth along a length of the handle. Particularly, the slide 58 is captively held, for back-and-forth movement, in a longitudinal slot 60 formed through side 18 of the handle 12. The slide 58 includes a thumb button 62 that is located on the exterior side of the handle 12 and which is engageable by user's thumb to move the slide along the slot 60 when the user is holding the handle. The slide 58 also includes a curved bow 64 that is located on the interior side of the handle within the receptacle 22. The bow 64 is configured to press against the side of the container body 28 and compress or squeeze the container body against the receptacle wall as the slide is moved in a direction toward end 14 of the handle 12.

While not shown, slide 58 may be retained at incremental forward positions by a retaining mechanism, such as, for example a linear ratchet and pawl to prevent backward movement once the slide is advanced in a forward direction. In an embodiment, the slide may be fitted with a pawl that is engageable with a ratchet located along the length of the slot. The pawl can be disengaged from the ratchet to move the slide backward.

Tool 10 further includes a sanding block 66. As illustratively shown, the sanding block 66 may comprise a foam body having a working surface 68 that has an abrasive dispose therealong and an opposite mounting surface 70. The sanding block 66 is removably attachable to sanding pad 72 which is connected to end 16 of the handle 12 by neck 74. The sanding block 66 may be removably attached to sanding pad 72 by a touch fastener, such as, for example, a hook-and-loop fastener wherein the loop fastener material may be disposed on one of the mounting surfaces 70 or the sanding pad 72 and the hook material disposed on the opposite.

Alternatively, while not shown, the sanding block 66 could be replaced by sandpaper that is attachable to the sanding pad 72. Further, in other embodiments, it is contemplated the sanding pad 72 could be shaped to sand interior corners or shaped to sand exterior corners. In such an embodiment, the sand block 66 would be shaped to correspond to the shape of the sanding pad. In other embodiments, it is contemplated to provide tool 10 such that the sanding pad 72 may be detached from the handle and be provided with different shaped sanding pads and corresponding sanding blocks. In such an embodiment, the tool 10 could be configured such that the sanding pad 72 is removably attached to the neck 74 or the neck with the sanding pad is removably attached to the handle.

Several embodiments of the present invention have been described. Nevertheless, it will be understood that various modifications may be made without departing from the spirit and scope of the invention. Accordingly, other embodiments are within the scope of the following claims.

What is claimed is:

1. A surface repair tool comprising:

a handle having opposite first and second ends, a length extending between said first and second ends, and first and second opposite sides, said handle defining an internal receptacle for removably receiving a container therein and a passage extending from an end wall of said receptacle through an end wall of the handle at said first end of said handle;

a blade attached to and extending outwardly from said first end of said handle, said blade having a blade edge, an application surface, and a flow passage terminating at an orifice formed through said application surface;

a collapsible container removably positioned in said receptacle and having an opening through which a repair compound in said container can flow, said opening of said collapsible container fluidically connected to said flow passage of said blade;

a slide captively held, for back-and-forth movement, in a longitudinal slot formed through said first side of said handle, said slide having a thumb button located on an exterior side of said handle and a curved bow located on an interior side of said handle within said receptacle, said curved bow pressing against said collapsible container when said slide is moved in a direction toward said first end to compress said container and dispense repair compound through said orifice and onto said application surface;

a sanding pad attached to said second end of said handle; and an abrasive on said sanding pad.

2. The surface repair tool of claim 1, wherein said abrasive is a sanding block having a body of foam, said body having a working surface that has an abrasive dispose therealong and an opposite mounting surface that is attached to said sanding pad.

3. The surface repair tool of claim 2, wherein said sanding block is removably attached to said sanding pad.

4. The surface repair tool of claim 1, wherein said handle further comprises an opening formed through said second side thereof through which said container is insertable into said receptacle.

5. The surface repair tool of claim 4, further comprising a cover removably attachable to said handle to close said opening.

6. The surface repair tool of claim 1, wherein said container has a foil container body.

7. A surface repair tool comprising:

a handle having opposite first and second ends, a length extending between said first and second ends, and first and second opposite sides, said handle configured to by grasped by a user's hand, said handle defining an internal receptacle for removably receiving a container therein, an aperture through an end wall of said receptacle and a passage extending through an end wall of the handle approximate said first end and connecting with said aperture;

a blade attached having a blade edge, an application surface, a neck, a flow passage extending through said neck and terminating at an orifice formed through the application surface, and a back edge opposite of said blade edge, said neck extending outwardly beyond said back edge and terminating at a free end with an opening into said flow passage;

a container having a collapsible body and a neck with a container opening into said container through which repair compound in said container can flow, said container removably positioned in said receptacle with said neck thereof disposed within said aperture;

said blade removably attached to said first end of said handle with said neck of said blade extending through said passage formed in said handle and with said opening of said neck of said blade fluidically connected to said opening of said container;

a slide captively held, for back-and-forth movement, in a longitudinal slot formed through said first side of said handle, said slide having a thumb button located on an exterior side of said handle and a curved bow located on an interior side of said handle within said receptacle, said curved bow pressing against said collapsible container when said slide is moved in a direction toward said first end to compress said container and dispense repair compound through said orifice and onto said application surface;

a sanding pad attached to said second end of said handle; and an abrasive on said sanding pad.

8. The surface repair tool of claim 7, wherein end said wall of the handle defines a slot, and wherein said back edge of said blade is removably received by said slot when said blade is attached to said handle.

9. The surface repair tool of claim 8, wherein said abrasive is a sanding block having a body of foam, said body having a working surface that has an abrasive dispose therealong and an opposite mounting surface that is attached to said sanding pad.

10. The surface repair tool of claim 9, wherein said sanding block is removably attached to said sanding pad.

11. The surface repair tool of claim 7, wherein said handle further comprises an opening formed through said second side thereof through which said container is insertable into said receptacle.

12. The surface repair tool of claim 11, further comprising a cover removably attachable to said handle to close said opening.

* * * * *